US011788443B2

(12) United States Patent
Stjernberg et al.

(10) Patent No.: US 11,788,443 B2
(45) Date of Patent: Oct. 17, 2023

(54) METHOD FOR CONTROLLING OIL PRESSURE IN AN OIL PUMP OF AN INTERNAL COMBUSTION ENGINE SYSTEM

(71) Applicant: VOLVO TRUCK CORPORATION, Gothenburg (SE)

(72) Inventors: Oscar Stjernberg, Gothenburg (SE); Martin Wilhelmsson, Gothenburg (SE)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 17/807,338

(22) Filed: Jun. 16, 2022

(65) Prior Publication Data

US 2022/0403763 A1 Dec. 22, 2022

(30) Foreign Application Priority Data

Jun. 21, 2021 (EP) ..... 21180632

(51) Int. Cl.
*F01M 1/16* (2006.01)
*F01M 1/02* (2006.01)

(52) U.S. Cl.
CPC ..... *F01M 1/16* (2013.01); *F01M 1/02* (2013.01); *F01M 2250/60* (2013.01)

(58) Field of Classification Search
CPC ..... F01M 1/02; F01M 1/16; F01M 2250/60
See application file for complete search history.

(56) References Cited

U.S. PATENT DOCUMENTS

2004/0187835 A1* 9/2004 Hoff ..... F01M 5/025 123/196 R
2013/0192557 A1 8/2013 Rollinger et al.
2015/0275713 A1 10/2015 Bidner et al.
2015/0377098 A1 12/2015 Murakami et al.
2020/0049034 A1* 2/2020 Enström ..... F01M 3/00

OTHER PUBLICATIONS

Extended European Search Report in corresponding European Application No. 21180632.8 dated Nov. 29, 2021 (8 pages).

* cited by examiner

*Primary Examiner* — Kevin A Lathers
(74) *Attorney, Agent, or Firm* — Venable LLP; Jeffri A. Kaminski

(57) ABSTRACT

A method for controlling oil pressure in a controllable oil pump of an internal combustion engine system. A vehicle is arranged in communication with a control unit, the method comprising: receiving an indication of an upcoming vehicle operating situation affecting an operation of the ICE system; determining an expected change in the operation of the ICE system for the upcoming vehicle operating situation; determining a current oil pressure of the oil pump; and on the basis of said determined expected change in the operation of the ICE system and the determined current oil pressure of the oil pump, determining a minimum oil pressure for the oil pump for the upcoming vehicle operating situation.

16 Claims, 6 Drawing Sheets

METHOD FOR CONTROLLING OIL PRESSURE IN AN OIL PUMP OF AN INTERNAL COMBUSTION ENGINE SYSTEM

TECHNICAL FIELD

The present disclosure relates to a method for controlling oil pressure in an oil pump of an internal combustion engine system. The method is particularly applicable for powertrain systems of vehicles comprising internal combustion engine systems. Although the method will mainly be described in relation to a truck, it may also be applicable for other types of vehicles propelled by means of an internal combustion engine. In particular, the present disclosure can be applied in heavy-duty vehicles, such as trucks, buses and construction equipment. The present disclosure also relates to a corresponding control unit for performing the method, as well as a vehicle comprising such a control unit.

BACKGROUND

There is a general desire for improving internal engine combustion (ICE) systems with regard to performance, efficiency, and operational costs. In addition, present regulatory conditions in the field of heavy-duty vehicles have led to an increasing demand for improving fuel economy and reducing emissions during ordinary use of such vehicles. In this context, the components making up the internal combustion engine system have been developed and improved in several different manners. However, there is also an increasing demand for monitoring the operations of the components of the ICE system to ensure an accurate and timely service of the ICE system. By way of example, a control unit of the vehicle may perform one or several types of estimations of the status of the ICE system on the basis of the current operation of the ICE system, e.g. tracking deviations in performance of one or more components.

Oil lubrication is one operation of particular interest for ensuring an efficient and robust ICE system. By way of example, the amount of oil lubrication needs to supplied on the basis of the operation of the vehicle in order to guarantee an optimal performance and extend the lifetime the ICE. Various ways of improving lubrication of ICE engine components have been proposed. US 2013/0192557 A1 discloses one example of a method for adjusting oil pressure supplied to engine components based on engine acceleration, in which the engine acceleration is used to predict future engine lubrication requirements so that oil pressure adjustment can be scheduled in a more timely fashion.

Despite the activity in the field of controlling lubrication of engine components by adjusting the oil pressure supplied to the engine, there remains a need for further improvements so as to meet lubrication demands in view of new developments and implementations of more advanced ICE systems and vehicles. It would therefore be desirable to provide a further improved and refined method for controlling oil pressure in engine systems in vehicles.

SUMMARY

An object of the disclosure is to provide an improved method for controlling oil pressure in an oil pump of an internal combustion engine system of a vehicle, which method provides for a simple, yet precise, and dynamic way of ensuring adequate lubrication and/or cooling of engine components during ordinary use of the vehicle.

According to a first aspect of the disclosure, the object is achieved by a method for controlling oil pressure in a controllable oil pump of an internal combustion engine (ICE) system of a vehicle. The method comprises: receiving an indication of an upcoming vehicle operating situation affecting an operation of the ICE system; determining an expected change in the operation of the ICE system for the upcoming vehicle operating situation; determining a current oil pressure of the oil pump; and, on the basis of the determined expected change in the operation of the ICE system and the determined current oil pressure of the oil pump, determining a minimum oil pressure for the oil pump for the upcoming vehicle operating situation.

In this manner, it becomes possible to adjust the oil pressure of the oil pump in a more accurate and predictable manner so that a precise lubrication of one or more engine components can be provided without a delay when the vehicle demands more power from the ICE system. In other words, an adequate lubrication of the component(s) of the ICE may occur substantially at the same time as the vehicle demands more power from ICE system. In particular, the provisions of determining the upcoming vehicle operating situation, the expected change in the ICE system operation and the current oil pressure in the oil pump, allow for a more advanced and dynamic prediction of a future needed oil pressure of the oil pump in order to optimize the lubrication of the engine component(s) for the upcoming vehicle operating situation. Since the provisions of receiving an indication of an upcoming vehicle operating situation affecting an operation of the ICE system and determining an expected change in the operation of the ICE system for the upcoming vehicle operating situation provide information relating to a range of parameters that influence the lubrication need during the future operation, e.g. along an upcoming route segment, the lubrication need of the engine components can not only be estimated in a predictive manner for longer time horizons than hitherto known prior art methods, but also in a more accurate fashion such that oil pressure may be adjusted in an even more timely manner. To this end, the oil pressure of the oil pump can be corrected in a predictive manner so that adequate lubrication can be provided simultaneously with the changed demands on the ICE system, e.g. a change in engine speed and/or engine torque due to the upcoming vehicle situation.

The ICE system is generally comprised with the vehicle. The vehicle is further arranged in communication with a control unit, as further described herein.

The example embodiments of the present disclosure are particular useful for a diesel ICE system operated on diesel, in which the demands for adequate lubrication may be higher compared to other ICE systems. An additional advantage with providing an adequate lubrication of engine components is longer lifespan which in turn equals less down time. Adequate pressure of the oil for a given operation of the ICE system may further contribute to an improved cooling of the engine components since oil is also used for cooling engine components such as the pistons. By having adequate oil pressure at all time, efficient cooling of engine components is achieved which decreases fuel consumption. It should be noted that the method may also be useful in other types of ICE systems and vehicles than diesel heavy-duty vehicles.

The method may further comprise a number of additional steps to estimate if the oil pressure of the oil pump should increase, decrease, or be maintained at the determined current oil pressure level, as will be further described in the following. By way of example, the method may further comprise determining that the oil pressure is at a predetermined oil pressure value when the vehicle reaches the upcoming vehicle operating situation, on the basis of the determined minimum oil pressure. As such, the method may comprise the step of determining a desired start for adjusting the oil pressure of the oil pump to the determined minimum oil pressure based on a determined start of the upcoming vehicle operating situation. By way of example, the method may determine to increase the operation of the oil pump at a point in time or at a certain location of the vehicle on a route segment, so that the oil pressure in the oil pump is at the predetermined oil pressure value when the vehicle reaches the upcoming vehicle operating situation on the basis of the determined minimum oil pressure. In this manner, it becomes possible to control the oil pump in an even more precise manner in view of the start of the upcoming vehicle driving situation and the determined expected change in operation of the ICE system.

Typically, although strictly nor necessary, the method may select between increasing the oil pressure, decreasing the oil pressure, or maintaining the oil pressure of the oil pump on the basis of the determined expected change in the operation of the ICE system and the determined current oil pressure of the oil pump.

According to at least one embodiment, the method further comprises determining to increase the operation of the oil pump to increase the oil pressure if the determined expected change in the ICE system operation amounts to an increase of the ICE system operation compared to a current level of the ICE system operation. By way of example, increasing the operation of the oil pump to increase the oil pressure may be advantageous when the upcoming vehicle operating situation is e.g. an uphill slope, an acceleration lane, and the like, thus requiring an increased lubrication and/or cooling of the engine components during the upcoming vehicle operating situation.

In addition, or alternatively, the method may further comprise determining to reduce the operation of the oil pump to decrease the oil pressure if the determined expected change in the ICE system operation amounts to a reduction of the ICE system operation compared to a current level of the ICE system operation. In this manner, it becomes possible to predict changes in the ICE operations that may result in a lower oil pressure demand, and thus allow for an early reduction of the oil pressure of the oil pump, thus enabling an improved fuel consumption since a lower oil pressure generally has a positive impact on the overall fuel consumption of the vehicle. By way of example, decreasing the operation of the oil pump to decrease the oil pressure may be advantageous when the upcoming vehicle operating situation is e.g. a longer downhill slope. In this context, it may be noted that a low oil pressure is less fuel consuming because extra energy to drive the oil pump is not required. Also, by not driving the oil pump at high levels all the time, it becomes possible to reduce wear and tear on the oil system (pump, filters).

By way of example, the provision of determining an expected change in the operation of the ICE system for the upcoming vehicle operating situation comprises determining any one of an expected change in engine load, engine torque, engine revolution and engine acceleration for the upcoming vehicle operating situation. While it has been observed that any one of these parameters provides an accurate understanding of the situation on an individual basis, the combination of the data may provide particularly benefits for determining the expected change in the operation of the ICE system for the upcoming vehicle operating situation. By way example, the engine torque can vary despite that the engine acceleration is constant. Hence, the method according to the example embodiment can be used in several different situations for controlling the oil pressure of the oil pump in a more predictive manner, e.g. due to the use of the route information, as described herein.

According to at least one embodiment, the method further comprises determining an expected change in the operation of the ICE system for an upcoming vehicle operating situation based on route information describing at least a route segment from a starting point to an end point.

By means of the route information, the expected change in the operation of the ICE system can be determined in order to provide a more accurate estimation of the required minimum oil pressure for lubricating the engine component(s). Since the route information can provide information relating to a range of parameters which influence the need for lubrication as well as the power consumption along the route, the lubrication and oil pressure level needs of the oil pump can also be estimated for the route as a whole. This means that it is possible to adjust the oil pressure of the oil pump only when the predicted route as planned or specific segments within the route would lead to an increase or decrease of the operation of the ICE system, e.g. an increase or decrease in engine load. Accordingly, it becomes possible to operate the oil pump at pressures closer to a minimum oil pressure limit for the route segment if it is predicted that the ICE system and the oil pump already operate within a required range for the predetermined route or regulate the oil pressure of the oil pump to another minimum oil pressure limit for the route segment if it is predicted that the ICE system and the oil pump will operate at another required range for the predetermined route that is different to the current range. Typically, the route information may contain any one of an indication of a speed limit, road type, road elevation profile, construction work, traffic flow. In addition, or alternatively, the method may further comprising acquiring weather information for the upcoming vehicle operating situation.

According to at least one embodiment, the provision of determining an expected change in the operation of the ICE system is determined based on a previous ICE operating profile for the route segment.

Optionally, the previous ICE operating profile for the route segment may be based on previous vehicle operating cycle statistics.

According to at least one embodiment, the method further comprises determining a duration of the upcoming vehicle operating situation. By determining a duration of the upcoming vehicle operating situation, it becomes possible to more precisely determine if and when the oil pressure of the oil pump needs to be adjusted in order to reach the minimum oil pressure level at the start of the upcoming vehicle operation situation.

According to at least one embodiment, the method further comprises to adjust the oil pressure of the oil pump only if the duration of the upcoming vehicle operating situation exceeds at least 10 seconds. Still preferably, the method further comprises to adjust the oil pressure of the oil pump only if the duration of the upcoming vehicle operating situation exceeds at least 30 seconds. In this manner, the method may only select to adjust the oil pressure for vehicle operating situations where a change in the oil pressure may be particularly beneficial for the lubrication and cooling of the engine components.

On the other hand, the time for adjusting the oil pressure from its current oil pressure level to the desired adjusted oil pressure level may only be a couple of seconds. That is, the total time between the start of the pump to build pressure until the time the oil system can start benefit from the increased oil pressure may only be a couple of seconds.

According to at least one embodiment, the upcoming vehicle operating situation is detected based on route information describing at least a route segment from a starting point to an end point.

According to at least one embodiment, the method further comprises determining a start of the upcoming vehicle operating situation and a start for adjusting the oil pressure of the oil pump to the determined minimum oil pressure based on the determined start of the upcoming vehicle operating situation.

According to at least one embodiment, the method further comprises monitoring the oil pressure of the oil pump until the start of the upcoming vehicle operating situation and adjusting the start for adjusting the oil pressure of the oil pump if the monitored oil pressure deviates from a thresholds value.

Typically, although not strictly required, the determined minimum oil pressure for the upcoming vehicle operating situation may at least partially be determined on the basis of an oil pressure model data indicative of a needed oil pressure level for the determined expected change in the operation of the ICE system. In addition, or alternatively, the determined minimum oil pressure for the upcoming vehicle operating situation may at least partially be determined on the basis of an oil pressure map indicative of a needed oil pressure level for the determined expected change in the operation of the ICE system.

At least one sensor may be used to determine the current oil pressure of the oil pump, as is commonly known in the art. By way of example, the sensor is a pressure sensor arranged downstream an oil outlet of the oil pump and upstream an ICE component in need of lubrication during operation of the ICE system. Such sensors are commonly used within the field of internal combustion engine systems. The sensor may be configured to collect data on the oil pressure during operation of the ICE system. The data collected is subsequently evaluated by a control unit, whereby an operational response of the oil pump can be determined in conjunction with the determined change of the ICE system for the upcoming vehicle operating situation. The operational response may e.g. be that the oil pressure needs to be increased, decreased, or maintained, as mentioned herein. Such correlation of the oil pump may e.g. be performed by the control unit.

The method according to the example embodiments may generally be performed during operation of the vehicle along a route segment, but also e.g. at vehicle start up, i.e. when the ICE is ignited or when the power in the vehicle is turned on.

According to one example embodiment, the method steps are performed by a control unit. The control unit may be a single control unit, or a number of control units interconnected and collaborating in a distributed network forming a distributed control unit.

According to a second aspect of the present disclosure, there is provided a control unit for a vehicle. The control unit may be arranged in communication with an oil pump of an internal combustion engine, ICE, system. The control unit is configured to perform any one of the provisions, steps and example embodiments of the method as described above in relation to the first aspect of the present disclosure. Effects and features of the second aspect are largely analogous to those described above in relation to the first aspect of the present disclosure.

According to at least one embodiment, the control unit is configured select between increasing the oil pressure, decreasing the oil pressure, or maintaining the oil pressure of the oil pump on the basis of the determined expected change in the operation of the ICE system and the determined current oil pressure of the oil pump.

It should be noted that the control unit may include a microprocessor, microcontroller, programmable digital signal processor or another programmable device. The control unit may also, or instead, include an application specific integrated circuit, a programmable gate array or programmable array logic, a programmable logic device, or a digital signal processor. Where the control unit includes a programmable device such as the microprocessor, microcontroller or programmable digital signal processor mentioned above, the processor may further include computer executable code that controls operation of the programmable device. The control unit may be arranged in the fuel pump, in the ICE system or in another remote location of the vehicle. Thus, the vehicle comprises the control unit.

According to a third aspect of the present disclosure, there is provided a vehicle comprising an internal combustion engine system having a controllable oil pump, and further a control unit as described above in relation to the second aspect of the present disclosure. Besides that the ICE system comprises the oil pump in fluid communication with the ICE, the ICE may typically comprise at least one cylinder at least partly defining a combustion chamber. Further, the engine comprises a reciprocating piston operable between the bottom dead centre and the top dead centre in the cylinder. The piston is generally connected to a crankshaft housed in a crankcase. Thus, the connecting rod connects the piston to the crankshaft. As the engine typically comprises a number of cylinders, each one of the cylinders also includes any one of the above features relating to the piston, combustion chamber and connecting rod. Moreover, the vehicle may generally comprise a turbocharger arrangement. In addition, the ICE may generally comprise at least one component in need of lubrication during operation of the ICE system and the vehicle. The at least one ICE component is arranged in fluid communication with the controllable oil pump. By way of example, the oil pump is configured to be controllable by the control unit so as to regulate the oil pressure in response to receiving a control signal from the control unit. The control signal may e.g. include data indicating the determined minimum oil pressure for the oil pump for the upcoming vehicle operating situation.

According to a fourth aspect of the present disclosure, there is provided a computer program comprising program code means for performing the steps described above in relation to the first aspect of the present disclosure when the program is run on a computer.

According to a fifth aspect of the present disclosure, there is provided a computer readable medium carrying a computer program comprising program means for performing the steps described above in relation to the first aspect of the present disclosure when the program means is run on a computer.

Effects and features of the third, fourth and fifth aspects are largely analogous to those described above in relation to the first aspect of the present disclosure.

Further advantages and advantageous features of the disclosure are disclosed in the following description and in the dependent claims. The skilled person will realize that different features may be combined to create embodiments other than those described in the following, without departing from the scope of the present disclosure.

The terminology used herein is for the purpose of describing particular examples only and is not intended to be limiting of the disclosure. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

BRIEF DESCRIPTION OF THE DRAWINGS

The above, as well as additional objects, features and advantages of the present disclosure, will be better understood through the following illustrative and non-limiting detailed description of exemplary embodiments of the present disclosure, wherein.

Figure 1:
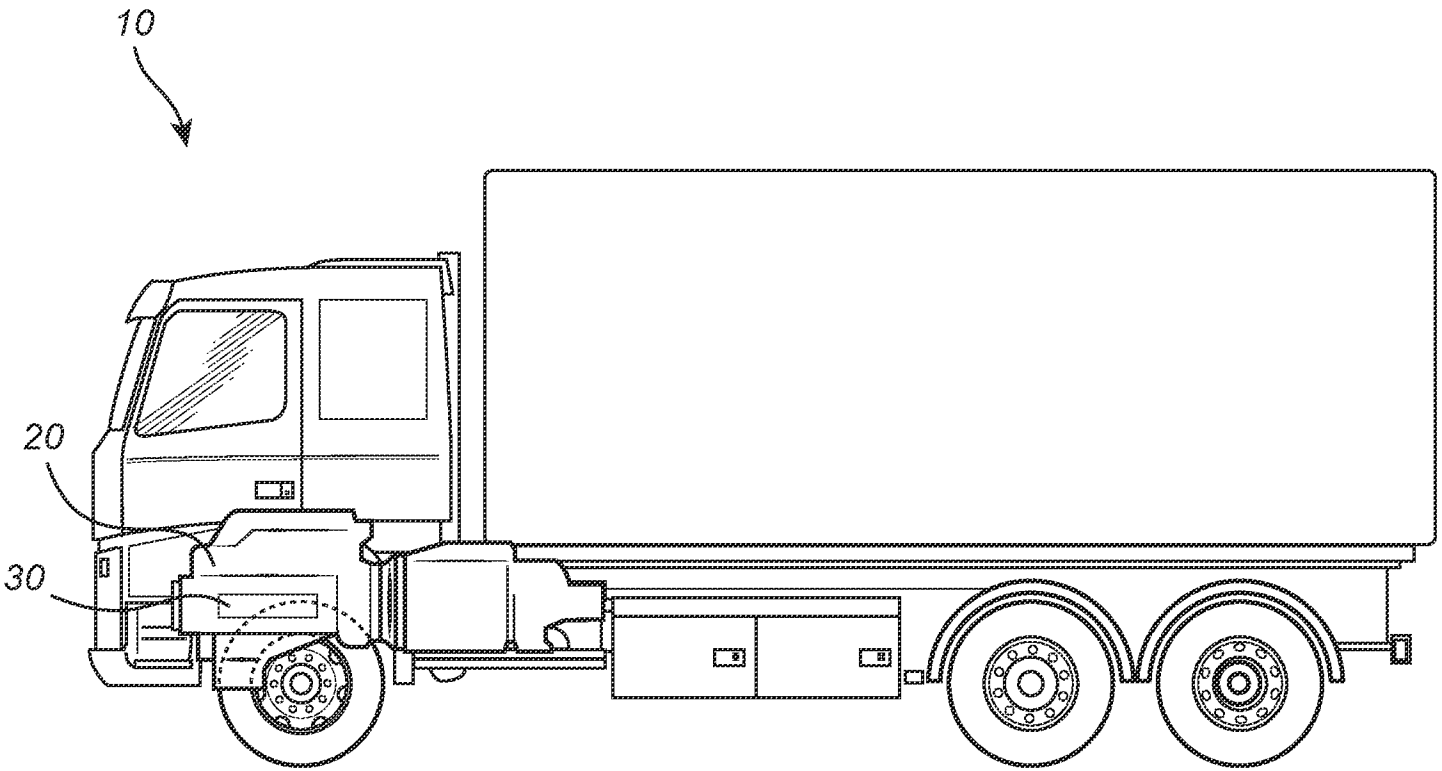
FIG. 1 schematically illustrates a vehicle provided with an internal combustion engine system configured to be operated according an embodiment of the disclosure.

With reference to the appended drawings, below follows a more detailed description of the embodiments of the disclosure cited as examples.

DETAILED DESCRIPTION OF EXAMPLE EMBODIMENTS OF THE DISCLOSURE

The present disclosure will now be described more fully hereinafter with reference to the accompanying drawings, in which exemplary embodiments of the disclosure are shown. The disclosure may, however, be embodied in many different forms and should not be construed as limited to the embodiments set forth herein; rather, these embodiments are provided for thoroughness and completeness. The skilled person will recognize that many changes and modifications may be made within the scope of the appended claims. Like reference character refer to like elements throughout the description.

Figure 2:
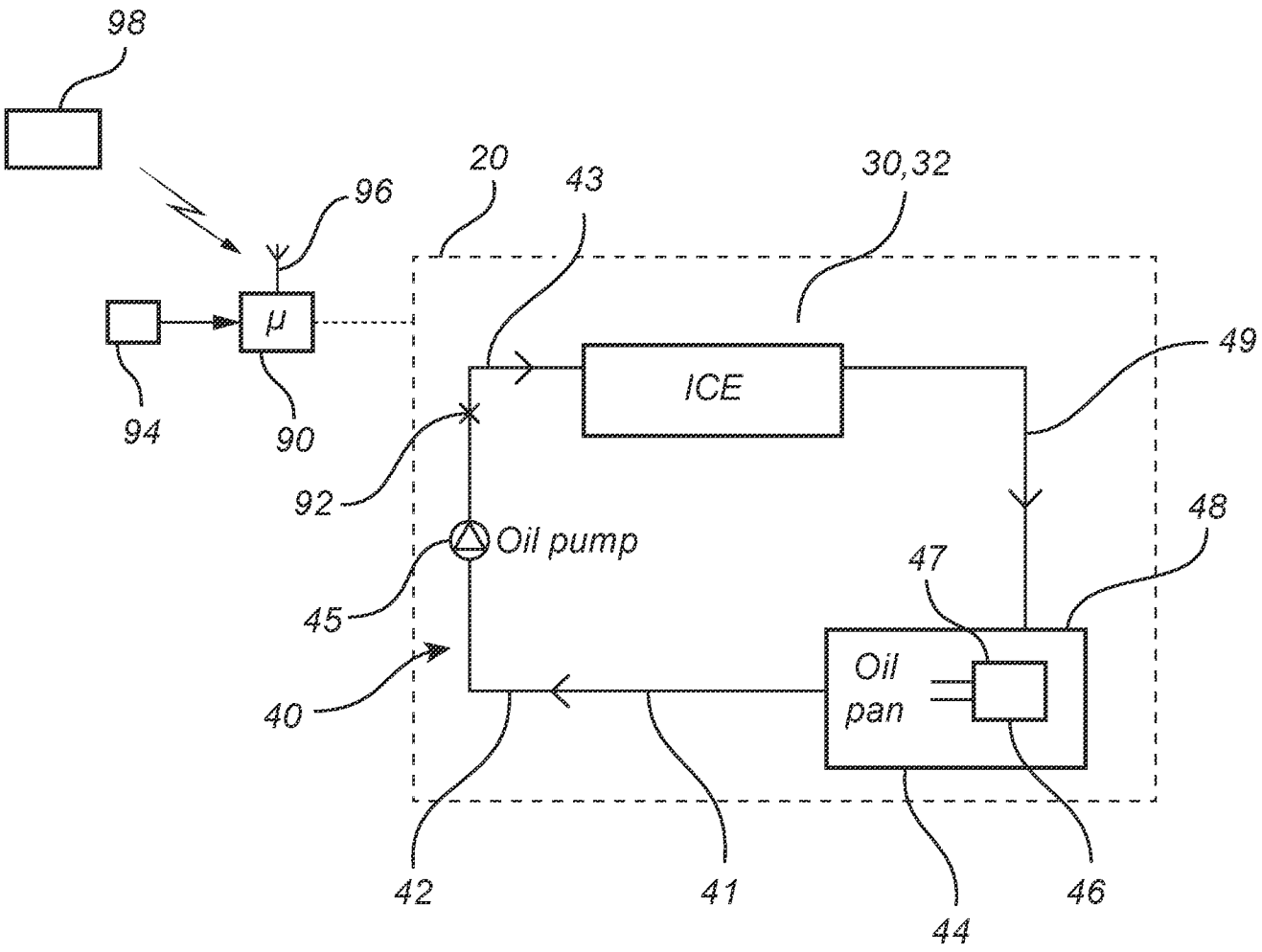
FIG. 2 schematically illustrates further components of the internal combustion engine system according to FIG. 1, comprising a lubrication system and a controllable oil pump for controlling the oil pressure of at least one engine component of the internal combustion engine system according to an embodiment of the present disclosure.

FIG. 1 illustrates a vehicle in the form of a truck 10. The vehicle comprises an internal combustion engine (ICE) system 20. The ICE system 20 is here an integral part of a powertrain system (although not explicitly illustrated in FIG. 1) that may generally include additional components for providing traction power to the vehicle 10 and operating the vehicle along a route. Moreover, the ICE system 20 includes an internal combustion engine 30. In this example, the ICE 30 is a diesel piston engine. In the ICE 30, fuel and oxygen are combined in a combustion process to produce power to turn a crankshaft (not shown) of the ICE 30. The combustion generates high pressure exhaust gas which exerts a force on the face of a piston of the ICE, although not specifically illustrated in FIG. 1. The piston reciprocates inside a cylinder and is connected to the crankshaft by a connection rod which transmits the power. In order to provide a reliable operation of the ICE system 20, the ICE system 20 generally comprises an ICE oil lubrication system 40, as is illustrated in FIG. 2. The function of the ICE oil lubrication system 40 is thus to distribute oil to the moving parts of the ICE system 20 to reduce friction between mating or moving surfaces which rub against each other. The ICE oil lubrication system may simply be denoted as the oil lubrication system or the lubrication system. The lubrication system generally contains an oil of a suitable type with a suitable viscosity, as is generally known in the art. It should be noted that the oil can likewise be used for cooling the engine components, as is commonly known in the art.

Turning now to FIG. 2, conceptually illustrating further components of the ICE system 20 according to FIG. 1, where the ICE system 20 comprises the oil lubrication system 40 arranged and configured to lubricate one or more components of the ICE system 20. The oil lubrication system 40 is generally arranged and configured to provide lubricating oil to a moving component 32 of the ICE 30, such as the piston, connecting rod, crankshaft, and the like. Providing adequate lubricating of these engine components provides for a more reliable operation of the ICE system for many reasons. It is to be noted that the piston, connecting rod and the crankshaft are only a few examples of moving parts of the ICE system in need of lubrication.

While there are a number of different types of lubrication systems and interfaces between the components and the lubrication system, a typical example of a lubrication system 40 comprises an oil pan 44, an oil pump 45 and an oil filter 46. The oil filter 46 may generally be secured in the oil pan in a suitable manner. The oil filter may include a housing and a lid 47, configured to provide attachment of the oil filter to a part of the oil pan 44. In FIG. 2, there is depicted a schematic overview of the lubrication system 40 for supplying oil to a single movable component 32 of the ICE 30, i.e. an oil using movable engine component.

More specifically, the lubrication system 40 here comprises the oil pan 44 for holding oil received from the engine component 32, the oil pump 45 configured to be fluidly connected to the oil pan 44 for pumping oil from the oil pan 44 to the engine component 32, the oil filter 46 configured for cleaning the oil, and the lid 47 for sealingly securing the oil filter 46 to the oil pan 44. The lubrication system 40 further contains the oil 42. The ICE system 20 may typically include a plurality of engine components 32 in fluid communication with the oil pump 45.

In order to allow the oil pressure to be adjusted in a dynamic manner, the oil pump 45 is configured to be controllable so that the oil pump 45 can regulate the oil pressure in response to a control signal from a control unit 90. While the oil pump 45 can be provided in several different manners, the oil pump 45 may as an example be a variable-capacity oil pump. Thus, the term "oil pump" as used herein, typically refers to a controllable oil pump that is configured to control the oil pressure. Hence, the oil pump can e.g. be any type of oil pump that is controllable, besides oil pumps that are mechanically fixed to the drive shaft because such oil pumps are driven directly by the engine.

As seen in FIG. 2, the oil pump 45 is fluidly connected to the oil pan 44 by means of an oil pump supply line 41. The oil pump 45 is further fluidly connected to the engine component(s) 32 by means of an oil supply line 43 extending in-between the oil pump 45 and the engine component 32. The engine component 32 is arranged downstream of the oil pump 45. The oil pump 45 is configured to transfer oil to the engine component(s) 32. From the engine components 32, oil is returned to the oil pan 44 by means of an oil return line 49 arranged between the engine components 32 and the oil pan 44. For an arrangement where there are more than one engine components in need of lubrication, it should be noted that the oil return line 49 may correspond to a plurality of different lines or paths for which the oil is returned to the oil pan 44.

The lubrication system 40 may include a number of additional components and various sub-systems as is known in the art. Although not specifically illustrated, the lubrication system 40 may comprise an oil filter line, which is a branch from the oil supply line 43, and is thus arranged downstream of the oil pump 45, for transferring oil to the oil filter 46. Thus, the pressurized oil flow from the oil pump 45 will be divided into different sub portions, a first sub-portion in the oil filter line, and a second sub-portion in the oil supply line 43. Moreover, as seen in FIG. 2, the oil pan 44 comprises a housing 48, i.e. an oil pan housing, surrounding an interior volume for holding the oil in the oil pan 44. Generally, at least a portion of the oil filter 46, such as a filter outlet (not shown), is arranged in the interior volume of the oil pan 44. Further, the oil filter 46 may comprise a filter insert for cleaning the oil. The filter insert is provided with at least one filter element having a filter material body through which the oil is arranged to pass in order to be filtered. Hence, the filter material body will capture debris and impurities in the oil and will successively be degraded and in need of maintenance or change. The lubrication system 40 may include additional components that are well-known in the field, and thus not further described herein.

Referring again to FIG. 2, the ICE system 20 here also comprises the control unit 90 in the form of an ICE system control unit. The control unit 90 is configured to perform a method of controlling the oil pressure of the controllable oil pump 45 in FIG. 2. In addition, the control unit 90 is here configured to control operation of the powertrain system, the ICE system 20 and the ICE 30, including e.g. controlling the lubrication system 40 and the oil pump 45. Optionally, the lubrication system 40 comprises one or more sensors so as to gather relevant data from the ICE system 20 and the lubrication system 40. By way of example, the lubrication system 40 comprises a pressure sensor 92 for monitoring the oil pressure downstream the oil pump 45, as illustrated in FIG. 2. As such, the control unit 90 is in communication with the oil pump 45, the lubrication system 40 and the pressure sensor 92. The control unit 90 is therefore connected to the pressure sensor 92, where the pressure sensor 92 is used for acquiring an indication of a prevailing pressure level downstream the oil pump 45. The detected oil pressure detected by the pressure sensor 92 typically corresponds to the state pressure level of the lubrication system 40.

The control unit 90 is here also arranged in communication with a geolocation arrangement 96, such as a GPS receiver or a local positioning arrangement, such as for example a Wi-Fi positioning system. The control unit 90 may thus be configured to receive geolocation data via the radio or network communication (such as e.g. the Internet) or from any other suitable network communication interface. The control unit 90 may also be in communication with a navigation system 94 of the vehicle, which is in communication with the geolocation arrangement 96 (e.g. the GPS receiver).

The control unit 90 is here further arranged in communication with a remote server 98, for example by means of the radio or network communication (such as e.g. the Internet) 96. The remote server 98 is adapted to generate Real Time Traffic Information (RTTI) to be received at the control unit 90. The RTTI may for example comprise detailed traffic information in regard to the vicinity of the vehicle, such as the within the next 1000 meters, the next 2000 meters, the next 5000 meters, or less.

Moreover, the control unit 90 is configured to receive route information. Route information can for example be acquired from the navigation system 94 of the vehicle. Route information may also be acquired from the remote server 98 or a cloud environment using a wireless connection of the vehicle. Furthermore, certain route information may be provided by the driver of the vehicle. In addition to data relating to the destination, which is typically determined by the driver, the driver may also provide information describing planned stops along the route. The planned stop may for example be a planned lunch break or other stops.

Further, in line with conventional ICE systems, the control unit 90 is configured to control various other components of the ICE system and to receive various input signals from sensors of various kinds. The control unit 90 may include a microprocessor, microcontroller, programmable digital signal processor or another programmable device. The control unit may also, or instead, include an application specific integrated circuit, a programmable gate array or programmable array logic, a programmable logic device, or a digital signal processor. Where the control unit 90 includes a programmable device such as the microprocessor, microcontroller or programmable digital signal processor mentioned above, the processor may further include computer executable code that controls operation of the programmable device. Moreover, the control unit 90 may be a dedicated control unit for controlling the ICE system 20 and for performing the methods according to various embodiments of the disclosure. It is also possible that the described functionalities of the control unit 90 are provided by a general-purpose control unit or that the functionalities are distributed over several different control units.

Figure 5:
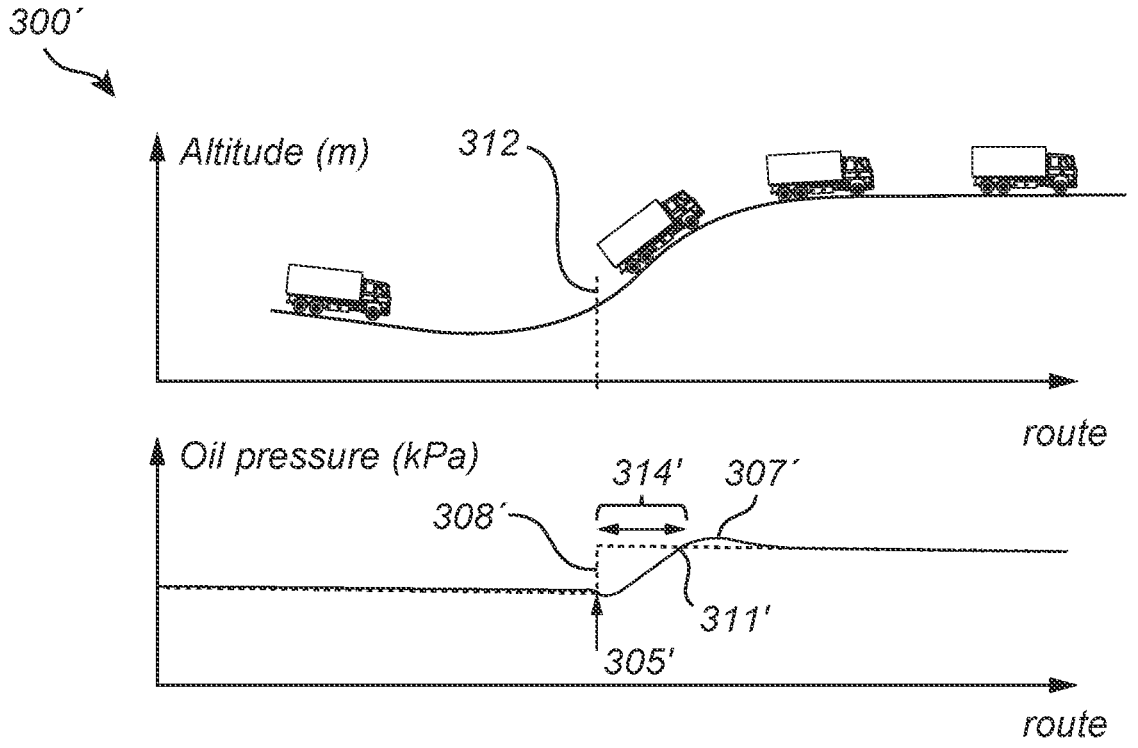
FIG. 5 provides an illustrative example of the operation of the vehicle with the ICE system operating according a conventional method of controlling the oil pressure of the oil pump.

Before turning to the example embodiments of a method according to the disclosure, a conventional prior art method for controlling oil pressure of the ICE system will be briefly described in relation to FIG. 5. FIG. 5 schematically illustrates a conventional control of the oil pressure according to an example that is not part of the example embodiments of the disclosure. In this prior art method, the vehicle 10 is driving along a route 300'. The upper part of FIG. 5 illustrates the change in altitude (y-axis) as a function of the route distance (x-axis), while the lower part of FIG. 5 illustrates the oil pressure as a function of the route distance (x-axis). In the lower part of FIG. 5, the curve in bold line 307' indicates the prevailing oil pressure of the oil pump, while the curve in dashed line 308' indicates the oil pressure demand. During operation of the vehicle 10, with further reference to FIG. 5, the vehicle 10 is illustrated to be travelling along the route 300' from a start position to an end position. At 312, the vehicle is driving uphill along a rather lengthy and inclined uphill slope. As a consequence, at least the load on the ICE will increase in order to provide appropriate extra power to the vehicle during the uphill operating situation. As such, there will be a change in the operations of the ICE at 305', where the ICE enters into a so-called high load mode. Consequently, there will be a rise in the oil pressure demand, as shown by a rise in the dashed line 308' at 305', which reflects an increase in the oil pressure demand due to the change 305' in the ICE operation. As may further be gleaned from FIG. 5, the ICE system 20 will demand more oil pressure due to the change of the vehicle operating situation. However, since there is often a delay for generating a sufficient oil pressure for sudden changes in engine load and/or engine acceleration, the oil pressure of the oil pump is not at a sufficient level until 311', which is the intersection of the oil pressure demand curve 308' (dashed line in FIG. 5) and the curve 307' illustrating the prevailing oil pressure of the oil pump (bold line in FIG. 5). In other words, there will be an oil pressure delay period 314', as shown in FIG. 5, which is defined as the difference between the intersection at 311' and the start of the oil pressure demand from the ICE, which in FIG. 5 corresponds to the start of the high load condition 305'.

Figure 3:
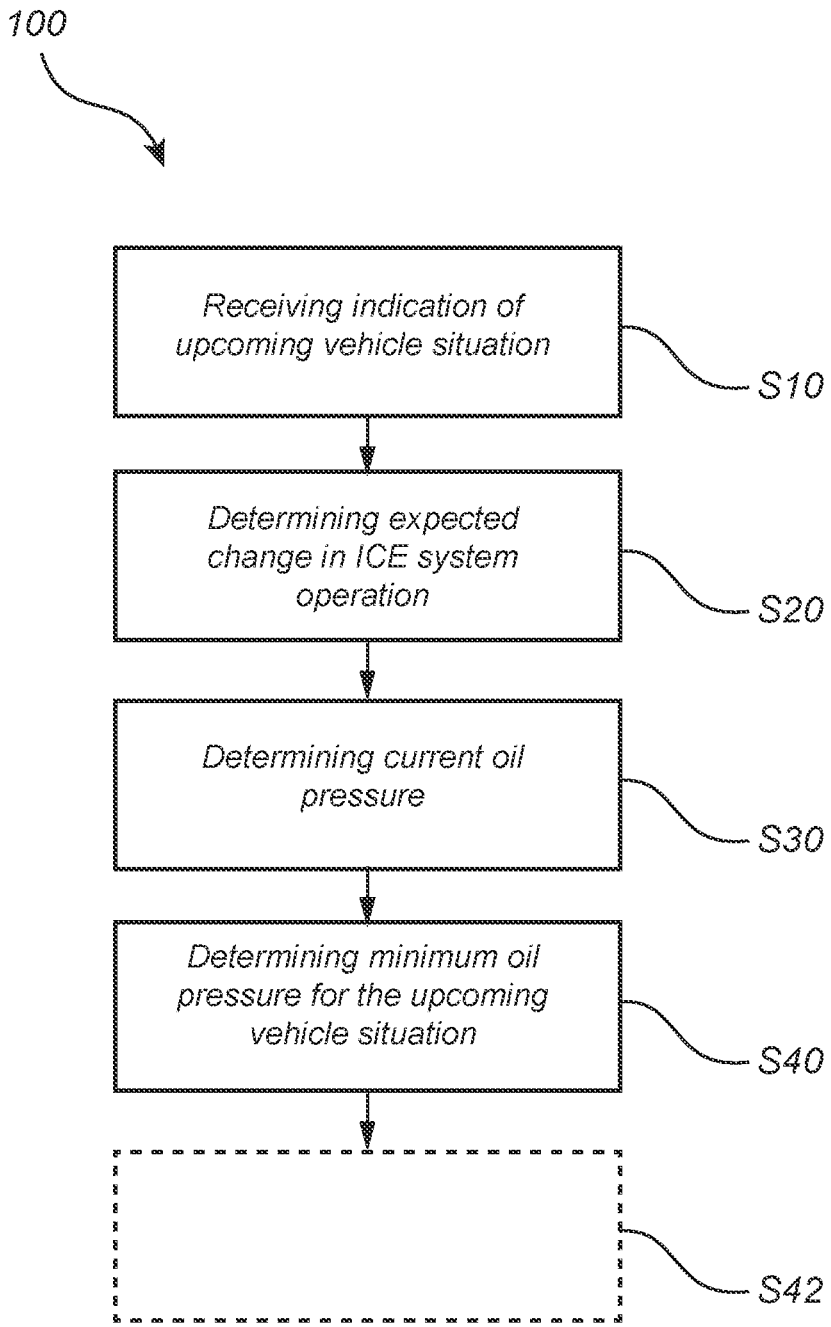
FIG. 3 shows a flow-chart of a method according to an embodiment of the present disclosure.

Turning now to FIG. 3, there is depicted a flow-chart of a method 100 according to example embodiments of the disclosure. The method is intended for controlling an oil pressure of the oil pump 45 of the ICE system 20 as described above in relation to FIGS. 1 and 2. The sequences of the method are here performed by the control unit 90, as described above in relation to the FIGS. 1 and 2. Thus, while referring to FIG. 3, a number of steps for controlling the oil pressure in the oil pump 45 of the ICE system 20 will now be described.

The method illustrated in FIG. 3 comprises at the least the following steps:

- receiving S10 an indication of an upcoming vehicle operating situation affecting an operation of the ICE system 20;
- determining S20 an expected change in the operation of the ICE system 20 for the upcoming vehicle operating situation;
- determining S30 a current oil pressure of the oil pump; and
- on the basis of the determined expected change in the operation of the ICE system 20 and the determined current oil pressure of the oil pump 45, determining S40 a minimum oil pressure for the oil pump for the upcoming vehicle operating situation.

Figure 6:
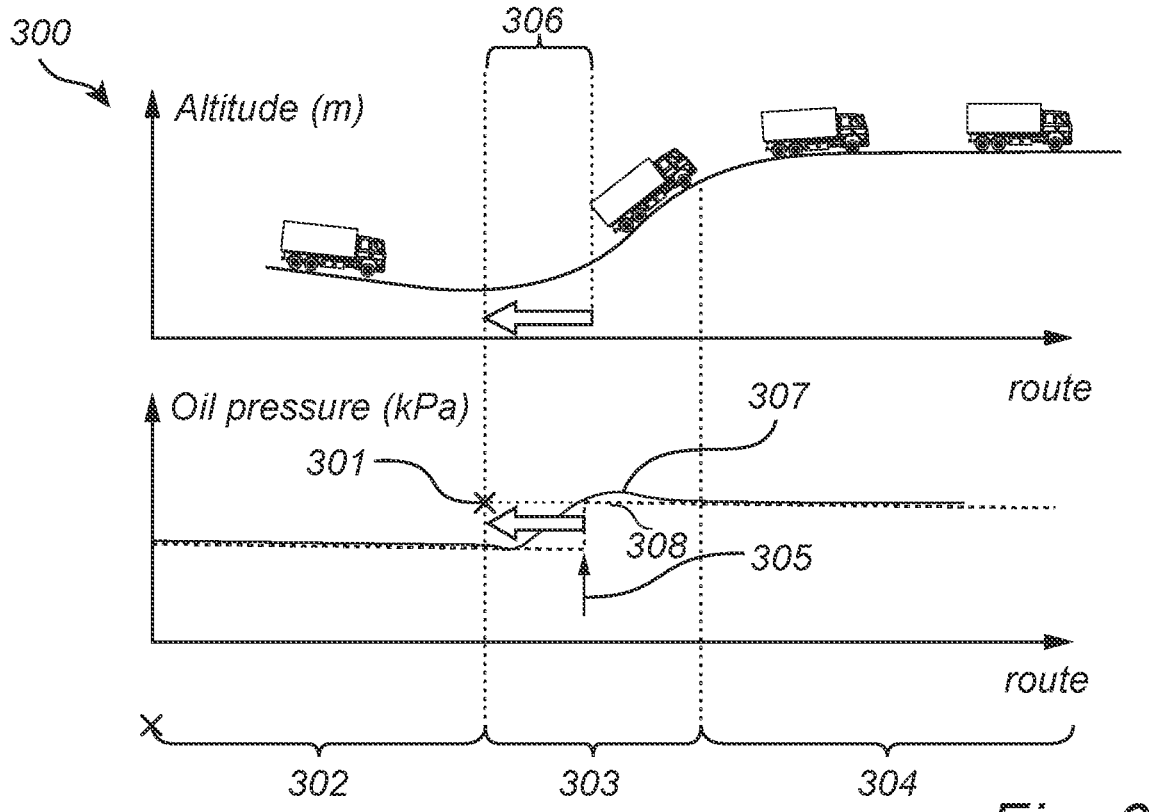
FIG. 6 provides an illustrative example of the operation of the vehicle with the ICE system operating according an embodiment of the method for controlling the oil pressure of the oil pump according to any one of the embodiments illustrated in FIGS. 3 to 4 according to the present disclosure.
Figure 7:
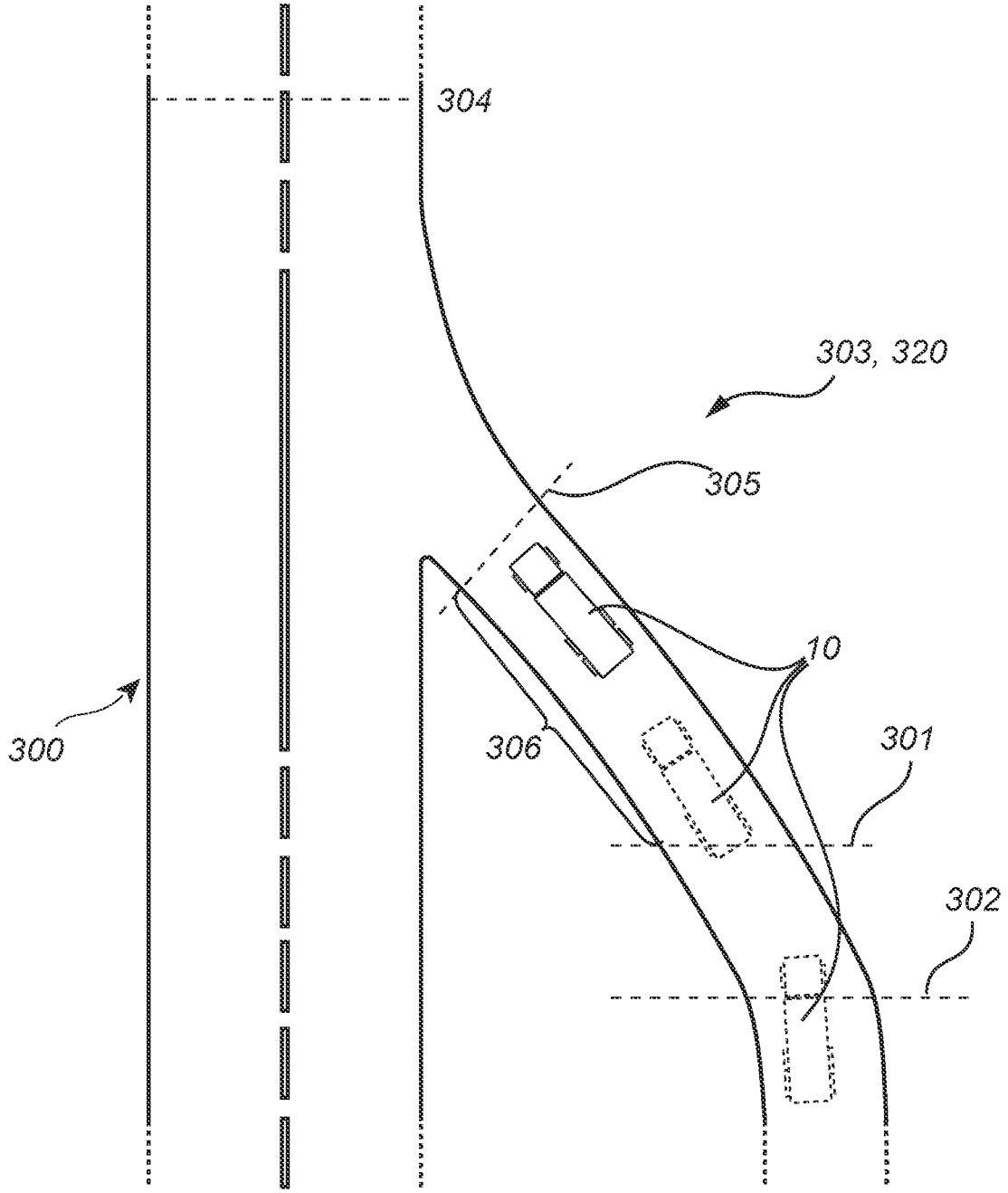
FIG. 7 illustrates another example of an illustrative example of the operation of the vehicle with the ICE system operating according an embodiment of the method of controlling the oil pressure of the oil pump according to any one of the embodiments illustrated in FIGS. 3 to 4 according to the present disclosure.

The sequences of the method may further be described in relation to one or more examples of an upcoming vehicle operations. FIGS. 6 and 7 schematically illustrate two examples of possible vehicle operating situations where the method is particularly useful so as to provide a more efficient and dynamic oil pressure regulation. During operation of the vehicle 10, with further reference to FIGS. 6 and 7, the vehicle 10 is illustrated to be travelling along a route 300 from a start position 302 to an end position 304. The route 300 is in the exemplifying drawings illustrated to comprise at least one separate segment 303, in which there will be a change 305 in the operation of the ICE system due to an identified change along the route segment, affecting the ICE operation. The route segment 303 here corresponds to the upcoming vehicle operating situation, in particular the change along the route segment corresponds to the upcoming vehicle operating situation, as described above in relation to the FIGS. 2 to 4. This is also indicated in FIGS. 6 and 7 as a start of a high load condition 305 of the ICE 30. That is, in FIGS. 6 and 7, the change in the route has an impact of the operation of the ICE system, such as change from a low load condition to the high load condition 305.

In FIG. 6, the vehicle 10 is approaching an uphill slope of the route 300. Hence, in this example, the route segment 303 is the uphill slope, which amounts to the upcoming vehicle operating situation. The upper part of FIG. 6 illustrates the change in altitude (y-axis) as a function of the route distance (x-axis), while the lower part of FIG. 6 illustrates the oil pressure as a function of the route distance (x-axis). Moreover, in the lower part of FIG. 6, the curve in bold line 307 indicates the prevailing oil pressure of the oil pump, while the curve in dashed line 308 indicates the oil pressure demand. Hence, the dashed line 308 indicates the oil pressure demand due to the change in the ICE operation. Generally, an increase in altitude along the route (corresponding to an uphill slope) requires an increased engine load, e.g. a need for an increased engine torque. As a consequence, the oil pressure will increase in order to provide a sufficient lubrication of the ICE 30 during the increased engine load.

Figure 4:
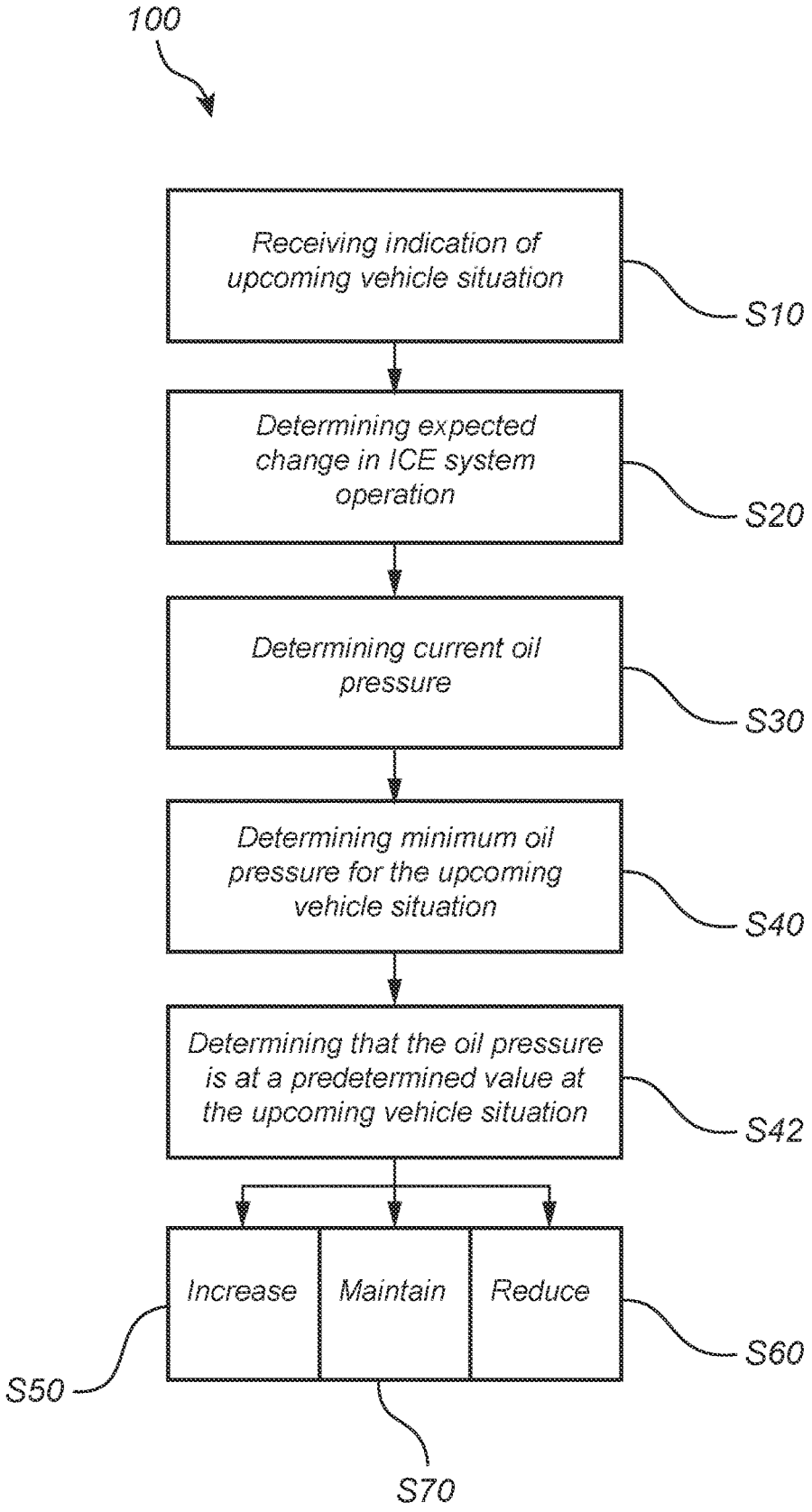
FIG. 4 shows a flow-chart of a method according to an embodiment of the present disclosure.

Thus, in FIG. 6, there is an increase in the ICE operation that amounts to an increase in the oil pressure level. The start of the high load ICE condition is indicated by 305. By the embodiments of the method as illustrated in FIGS. 3 and 4, it becomes possible to adjust the oil pressure of the oil pump so that the oil pressure is adjusted early and prior to approaching the start of the high load ICE condition 305. This early control adjustment of the oil pressure demand is provided by the method according to the example embodiments, as described herein, and is schematically illustrated by the period 306 in the upper part of FIG. 6.

In order to permit an early adjustment of the oil pressure of the controllable oil pump so as to handle the increased oil pressure demand at 305, the control unit 90 is configured to gather relevant route information. The route information is used as a basis for determining the expected change in the operation of the ICE system 20 for the upcoming vehicle operating situation. By way of example, at the start position 302, the control unit 90 receives, S10, an indication of an upcoming vehicle operating situation 303, which in the embodiment illustrated in FIG. 6 corresponds to the uphill slope. As is commonly known in the art, an upcoming vehicle operating situation in the form of driving uphill is likely to affect the operation of the ICE system to demand more power, thus requiring more lubrication or cooling of the engine components. Hence, such increase of the operation of the ICE will result in a demand on the oil pump to deliver a higher oil pressure during the route segment 303 compared to a previous route segment, e.g. at the start 302 of the route 300.

Typically, the route information comprises data indicating the starting point 302 and the end point 304 of the route 300 as illustrated by FIG. 6, thereby giving the travel distance. Moreover, in this example, the route information comprises the road elevation profile of the route 300, in particular the route elevation profile of the route segment 303.

Subsequently, on the basis of the received data indicating the road elevation profile, the control unit 90 is configured to determine the expected change in the operation of the ICE system 20 for the upcoming uphill slope, e.g. in comparison to a generally flat route segment without any change in altitude. It should be readily appreciated that the route information may comprise any or all of: speed limits, road type, road elevation profile, construction work, traffic flow, weather information or any other parameter that may influence the operation of the ICE system and thereby the oil pressure of the oil pump for the future route segment ahead of the vehicle. By way of example, the control unit 90 may also receive detailed traffic information from the remote server 98, as mentioned above. In one embodiment, the control unit receives data directly from the GPS receiver 96 and/or the navigation system 94 so as to correlate a current location of the vehicle 10 with the information received from the remote server 98, for determining when (exactly) the uphill slope is to be expected.

To sum up, while referring to e.g. FIG. 6, the method according to FIG. 3 determines the expected change in the operation of the ICE system 20 for the upcoming vehicle operating situation based on received route information describing at least the route 300 from the starting position 302 to the end position 304. The route 300 may be a predetermined segment of a planned route by the control unit 90 or a selected route segment 303 of the route ahead the vehicle 10, such as an uphill slope (FIG. 6) or an acceleration lane 320 (FIG. 7).

Subsequently, the control unit 90 receives data from the pressure sensor 92 so as to determine, S30, the current oil pressure of the oil pump 45, as mentioned above.

Based on the above received information, the control unit 90 determines, S40, that the upcoming uphill slope of the route will amount to a change of the ICE load, such as an increase in the ICE torque, of a magnitude requiring an increased demand for lubrication of the engine components during the uphill slope. Hence, based on the received information on the determined upcoming uphill slope of the route, the control unit 90 predicts that the oil pressure of the oil pump must be increased in comparison to the current oil pressure of the oil pump prior to reaching the detected upcoming uphill slope of the route so as to provide a sufficient lubrication of the engine components during the uphill slope of the route. To this end, the control unit 90 is configured to generally determine at least a minimum oil pressure of the oil pump 45 on the basis of the determined expected change in the operation of the ICE system and the determined current oil pressure of the oil pump.

Accordingly, while again referring to FIG. 6, the oil pump 45 may be operable at e.g. 301 to increase the oil pressure of the oil pump so that the oil pressure of the oil pump is at a sufficient level, or at least at a minimum level for handling the change (at 305) of the operation of the ICE, when the ICE demands more power, and thus more lubrication.

To this end, there will be an early rise in the oil pressure of the oil pump during the period 306 so that the oil pressure of the oil pump is at a sufficient level when there is a peak of the oil pressure demand at 305. This early oil pressure control adjustment of the oil pump is indicated by the arrows in FIG. 6. As may further be gleaned from FIG. 6, the ICE system 20 will demand more oil pressure due to the change in the vehicle operating situation at 305. However, due to the method of the example embodiment, there is no delay in the oil pressure rise. Rather, the method provides for delivering a sufficient oil pressure for the sudden change in the ICE operation (e.g. change in engine load) at 305, which is also exemplified by the intersection of the oil pressure demand curve 308 (dashed line in FIG. 6) and the curve 307 illustrating the prevailing oil pressure of the oil pump (bold line in FIG. 6) at 305 in FIG. 6. In other words, there will be no oil pressure delay period as previously indicated in relation to FIG. 5.

Typically, although strictly not required, the control unit 90 also determines when the oil pressure of the oil pump needs to be adjusted so as to ensure that a sufficient lubrication of the engine components is provided at and during the uphill slope of the route. In FIG. 6, the determined start of the oil pressure adjustment of the oil pump is indicated by reference numeral 301. In order to ensure that the oil pressure is at an appropriate level at the start of the high load condition 305 of the ICE system, the control unit 90 here determines to increase the operation of the oil pump at a point in time or at a certain location of the vehicle on the route, e.g. at 301, so that the oil pressure in the oil pump 45 is at the predetermined oil pressure value when the vehicle 10 reaches the upcoming vehicle operating situation on the basis of the determined minimum oil pressure. The minimum oil pressure and the predetermined oil pressure value may be derivable from an oil pressure model or from a conventional oil pressure map. By way of example, the data used as a basis for determining the required or minimum oil pressure for the upcoming vehicle operating situation may include an oil pressure model data indicative of a needed oil pressure level for the determined expected change in the operation of the ICE system. Thus, the method may include the step of determining the minimum oil pressure for the upcoming vehicle operating situation on the basis of an oil pressure model data indicative of a needed oil pressure level for the determined expected change in the operation of the ICE system. In other words, the method as illustrated in FIG. 3 here comprises the optional step of determining S42 that the oil pressure is at a predetermined oil pressure value when the vehicle reaches the upcoming vehicle operating situation on the basis of the determined minimum oil pressure.

In addition, or alternatively, the actual value of the minimum oil pressure for the determined change in the ICE operation may be derivable from the oil pressure map. By way of example, such oil pressure map contains suitable oil pressure levels as a function of predetermined data on specific engine speeds and engine torque. That is, the map may contain engine speed on the x-axis and engine torque on the y-axis, where the oil pressure can be selected depending on these two values.

In addition, or alternatively, the actual value of the minimum oil pressure for the determined change in ICE operation may be derivable from a machine learning model formed from vehicle data from the vehicle to thereby construct a model specific to that vehicle. For example, as the vehicle travels, more data is collected, to train a machine learning model, or add additional data to a statistical model. A model tailored to the specific vehicle provides for a model accurate for that specific vehicle which may have its own performance characteristics. However, the amount of data for constructing the model is limited to the data collected by that one vehicle. Accordingly, the value of the minimum oil pressure as well as the predetermined oil pressure level may be derivable from a simple look-up table, or in other embodiments such as a statistical model, or a machine learning model.

Adjusting the oil pressure on the basis of the determined expected change in the operation of the ICE system 20 and the determined current oil pressure of the oil pump 45 can be performed in several different manners by the control unit 90. In the driving situation illustrated in FIG. 6, the control unit 90 further determines to increase the operation of the oil pump 45 to increase the oil pressure of the oil pump because the determined expected change in the ICE system operation amounts to an increase of the ICE system operation compared to the determined current level of the ICE system operation.

In an extended version of the method illustrated in FIG. 3, the method comprises a number of additional steps to estimate if the oil pressure of the oil pump should increase, decrease, or remain at the determined current oil pressure level. FIG. 4 illustrates the various options of the adjustment of the oil pressure level depending on the determined expected change in the operation of the ICE system and the determined current oil pressure of the oil pump, as described above in relation to FIG. 3. In other words, the embodiment of the method illustrated in FIG. 4 generally includes the steps of the method as described above in relation to FIG. 3.

In addition, the control unit 90 is here configured to determine S50 to increase the operation of the oil pump to increase the oil pressure if the determined expected change in the ICE system operation amounts to an increase of the ICE system operation compared to a current level of the ICE system operation; determine S60 to reduce the operation of the oil pump to decrease the oil pressure if the determined expected change in the ICE system operation amounts to a reduction of the ICE system operation compared to a current level of the ICE system operation; and determine S70 to maintain the operation of the oil pump to maintain the oil pressure if the determined expected change in the ICE system operation amounts to a similar operation of the ICE system operation compared to a current level of the ICE system operation.

In other words, the method here comprises the step of determining S50 to increase the operation of the oil pump to increase the oil pressure if the determined expected change in the ICE system operation amounts to an increase of the ICE system operation compared to a current level of the ICE system operation. In addition, or alternatively, the method may comprise determining S60 to reduce the operation of the oil pump to decrease the oil pressure if the determined expected change in the ICE system operation amounts to a reduction of the ICE system operation compared to a current level of the ICE system operation. In addition, or alternatively, the method may comprise determining S70 to maintain the operation of the oil pump to maintain the oil pressure if the determined expected change in the ICE system operation amounts to a similar operation of the ICE system operation compared to a current level of the ICE system operation. As such, the control unit 90 is configured to select between the steps 50, 60 and 70 on the basis of the determined expected change in the operation of the ICE system and the determined current oil pressure of the oil pump.

Typically, if the method comprises the step 42 of determining S42 that the oil pressure is at a predetermined oil pressure value when the vehicle reaches the upcoming vehicle operating situation on the basis of the determined minimum oil pressure, also the method as illustrated in FIG. 4 may include the step of determining to increase 50, reduce 60 or maintain 70 the operation of the oil pump so that the oil pressure in the oil pump is at the predetermined oil pressure value when the vehicle reaches the upcoming vehicle operating situation on the basis of the determined minimum oil pressure.

Optionally, step S20 may comprises the step of determining if the determined expected change in the ICE system operation also differs from an expected operational behaviour of the ICE system by a threshold value indicative of a critical deviation in the operational behaviour of the ICE system. Such threshold value is generally stored in the control unit 90. If the determined expected change in the ICE system operation also differs from an expected operational behaviour of the ICE system by a threshold value, the step 40 here also comprises to include such information when determining the minimum oil pressure for the oil pump for the upcoming vehicle operating situation.

The expected change in the operation of the ICE system can be determined in several different manners. In this embodiment, the step of determining an expected change in the operation of the ICE system for the upcoming vehicle operating situation comprises determining any one of an expected change in engine load, engine torque, engine revolution and engine acceleration for the upcoming vehicle operating situation. That is, due to the upcoming vehicle operating situation, there will be a change in the operation of the ICE system. While the method may e.g. be used to determine the engine acceleration due to the upcoming vehicle operating situation, the method may also be used to adjust the oil pressure of the oil pump due to a change in engine torque, which may necessarily not be the same as a change in engine acceleration. That is, the engine torque can vary despite that the engine acceleration is constant. Hence, the method according to the example embodiment can be used in several different situations for controlling the oil pressure of the oil pump in a more predictive manner, e.g. due to the use of the route information, as described above.

It should be noted that the embodiments described herein are not limited to one specific model for determining the minimum oil pressure for the ICE system, as described herein. Rather, it may be possible to use several different models such an oil pressure data model and an oil pressure map. Which model to be used may in part depend on what information is available.

By way of example, the expected change in the operation of the ICE system may also be determined based on a previous ICE operating profile for the route segment 300. In this context, the previous ICE operating profile for the route segment 300 is based on previous vehicle operating cycle statistics for the same vehicle or for a different previous vehicle.

The expected change in the operation of the ICE system may also be determined by a combination of available data to determine oil pressure with the best possible accuracy given the available information. The amount of information and the accuracy of the gathered data may also dictate the maximum extent of a prediction window, i.e. for how long distance and/or time the oil pressure can be predicted with sufficient accuracy, thereby determining the length of the route segment. The prediction window also depends on the route information, where the oil pressure for example is more easily predictable for a road portion with a fixed speed limit and low traffic compared to for a road with varying speed limits and high traffic density. Thereby, the length of a segment may be based on speed limits of roads of the route. To this end, the method typically further comprises determining a duration of the upcoming vehicle operating situation. In view of the determined duration of the upcoming vehicle operating situation, it may be decided to adjust the oil pressure to a lower level, higher level, or maintain the current oil pressure.

Optionally, the oil pressure of the oil pump is only adjusted if the duration of the upcoming vehicle operating situation exceeds 10 seconds, still preferably exceeds 30 seconds.

To sum up, the method may generally comprise the step of determining when the oil pressure of the oil pump needs to be adjusted so as to ensure that a sufficient lubrication of the engine components is provided when the vehicle reaches the start 305 of the high load condition, as illustrated in FIG. 6. As such, in one example embodiment, the method comprises the step of determining the start of the upcoming vehicle operating situation corresponding to the start of the high load condition 305 of the ICE system by receiving an indication at the control unit 90 on the basis of the route information and/or previous driving cycles of the same vehicle or other vehicles of the same fleet.

Subsequently, the method comprises the step of determining the start for adjusting the oil pressure of the oil pump to the determined minimum oil pressure based on the determined start 305 of the upcoming vehicle operating situation. Referring to the example illustrated in FIG. 6, the start for adjusting the oil pressure of the oil pump to the determined minimum oil pressure is at the location 301. At this location 301, the control unit 90 transfers a signal to the oil pump to increase the oil pressure to the minimum oil pressure level for handling the determined high load condition at 305. To this end, the oil pressure of the oil pump 45 will be adjusted at least to a minimum oil pressure level so as to ensure that a sufficient lubrication of the engine components can be provided when the vehicle is at the location 305. This may result in that the oil pressure is either increased, decreased, or maintained in comparison to the current oil pressure of the oil pump.

Optionally, the method comprises the step of monitoring the oil pressure of the oil pump until the start of the upcoming vehicle operating situation and adjusting the start for adjusting the oil pressure of the oil pump if the monitored oil pressure deviates from a thresholds value.

In another example embodiment, as illustrated in FIG. 7, and also described above, the upcoming vehicle operating situation affecting the operation of the ICE system is an acceleration lane 320. In this embodiment, the control unit 90 receives an indication of an upcoming acceleration lane from e.g. the GPS receiver 96 or any other available traffic data communicated to the control unit 90 from the navigation system 94 of the vehicle. Thereafter, the control unit 90 is configured to perform similar steps as described above in relation to FIG. 6, so as to determine a minimum oil pressure for the oil pump for the upcoming acceleration lane 320. In FIG. 7 like references between FIG. 6 and FIG. 7 refer to like elements of the control unit and steps of the method.

The method may be executed as an on-board routine by the control unit 90. In addition, or alternatively, the method may be executed remote of the vehicle by a remote-control unit.

Although FIGS. 3 and 4 show a specific order of the method steps, the order of the steps may differ from what is depicted, and various method steps may be performed simultaneously or partially simultaneously.

The disclosure also relates to a control unit 90 for a vehicle as illustrated in FIG. 1, in which the control unit 90 is arranged in communication with the oil pump of the ICE system. The control unit 90 is configured to perform a method according to any one of the example embodiments as described in relation to the FIGS. 1 to 4 and FIGS. 6 to 7. In addition, the disclosure relates to the vehicle comprising the ICE system having a controllable oil pump, and further a control unit according to any one of the example embodiments as described in relation to the FIGS. 1 to 4 and FIGS. 6 to 7. In addition, the disclosure relates to a computer program comprising program code means for performing the steps of the method as described in relation to the FIGS. 1 to 4 and FIGS. 6 to 7, when the program is run on a computer. In addition, the disclosure relates to a computer readable medium carrying a computer program comprising program means for performing the steps of the method as described in relation to the FIGS. 1 to 4 and FIGS. 6 to 7 when the program means is run on a computer.

Thanks to the present disclosure, as exemplified by the example embodiments in FIGS. 1 to 4 and FIGS. 6 to 7, it becomes possible to correct oil pressure in a more precise and dynamic manner than hitherto known prior art methods, as illustrated e.g. in FIG. 5. As such, it becomes possible to predict a future required oil pressure of the oil pump so as to control a lubrication system of an ICE system so that lubrication will occur at the same time as a change in e.g. engine speed and/or torque of an ICE.

It is to be understood that the present disclosure is not limited to the embodiments described above and illustrated in the drawings; rather, the skilled person will recognize that many changes and modifications may be made within the scope of the appended claims. Thus, variations to the disclosed embodiments can be understood and effected by the skilled addressee in practicing the claimed disclosure, from a study of the drawings, the disclosure, and the appended claims.

The invention claimed is:

1. A method for controlling oil pressure in a controllable oil pump of an internal combustion engine (ICE) system, of a vehicle, the method comprising:

receiving an indication of an upcoming vehicle operating situation affecting an operation of the ICE system;

determining an expected change in the operation of the ICE system for the upcoming vehicle operating situation, wherein determining the expected change in the operation of the ICE system for an upcoming vehicle operating situation is determined based on route information describing at least a route segment from a starting point to an end point, and wherein determining the expected change in the operation of the ICE system is determined based on a previous ICE operating profile for the route segment;

determining a current oil pressure of the oil pump; and on the basis of said determined expected change in the operation of the ICE system and the determined current oil pressure of the oil pump, determining a minimum oil pressure for the oil pump for the upcoming vehicle operating situation.

2. The method according to claim 1, wherein, on the basis of said determined minimum oil pressure, further determining that the oil pressure is at a predetermined oil pressure value when the vehicle reaches the upcoming vehicle operating situation.

3. The method according to claim 1, further comprising determining to increase the operation of the oil pump to increase the oil pressure if the determined expected change in the ICE system operation amounts to an increase of the ICE system operation compared to a current level of the ICE system operation.

4. The method according to claim 1, further comprising determining to reduce the operation of the oil pump to decrease the oil pressure if the determined expected change in the ICE system operation amounts to a reduction of the ICE system operation compared to a current level of the ICE system operation.

5. The method according to claim 1, wherein determining an expected change in the operation of the ICE system for the upcoming vehicle operating situation comprises determining any one of an expected change in engine load, engine torque, engine revolution and engine acceleration for the upcoming vehicle operating situation.

6. The method according to claim 1, wherein the route information contains any one of an indication of a speed limit, road type, road elevation profile, construction work, traffic flow.

7. The method according to claim 1, wherein the previous ICE operating profile for the route segment is based on previous vehicle operating cycle statistics.

8. The method according to claim 1, further comprising determining a duration of the upcoming vehicle operating situation.

9. The method according to claim 8, further comprising to adjust the oil pressure of the oil pump only if the duration of the upcoming vehicle operating situation exceeds at least 10 seconds.

10. The method according to claim 1, further comprising determining a start of the upcoming vehicle operating situation and a start for adjusting the oil pressure of the oil pump to the determined minimum oil pressure based on the determined start of the upcoming vehicle operating situation.

11. The method according to claim 10, further comprising monitoring the oil pressure of the oil pump until the start of the upcoming vehicle operating situation and adjusting the start for adjusting the oil pressure of the oil pump if the monitored oil pressure deviates from a thresholds value.

12. The method according to claim 1, wherein the determined minimum oil pressure for the upcoming vehicle operating situation is at least partially determined on the basis of an oil pressure model data indicative of a needed oil pressure level for the determined expected change in the operation of the ICE system.

13. A control unit for a vehicle, arranged in communication with an oil pump of an internal combustion engine, ICE, system, and configured to perform a method according to claim 1.

14. A vehicle comprising an internal combustion engine, ICE, system having a controllable oil pump, and further a control unit according to claim 13.

15. A computer program comprising program code for performing the steps of claim 1 when said program code is run on a computer.

16. A non-transitory computer readable medium carrying a computer program comprising program code for performing the steps of claim 1 when said program code is run on a computer.

* * * * *